US005317978A

United States Patent [19]

Alexandersson

[11] Patent Number: 5,317,978

[45] Date of Patent: Jun. 7, 1994

[54] INCINERATING FURNACE

[76] Inventor: Sven Alexandersson, Sekreterarbacken 19, S-122 36 Enskede, Sweden

[21] Appl. No.: 941,150

[22] PCT Filed: May 6, 1991

[86] PCT No.: PCT/SE91/00323

§ 371 Date: Nov. 16, 1992

§ 102(e) Date: Nov. 16, 1992

[87] PCT Pub. No.: WO91/18243

PCT Pub. Date: Nov. 28, 1991

[30] Foreign Application Priority Data

May 23, 1990 [SE] Sweden ..... 9001875

[51] Int. Cl.[5] ..... F23G 1/00

[52] U.S. Cl. ..... 110/194; 110/211; 110/212; 110/214

[58] Field of Search ..... 110/194, 235, 211, 212, 110/214

[56] References Cited

U.S. PATENT DOCUMENTS

| | | | |
|---|---|---|---|
| 1,742,868 | 1/1930 | Mann | 110/194 |
| 4,321,878 | 3/1982 | Segrest | 110/194 |
| 5,014,630 | 5/1991 | Looker | 110/194 |

FOREIGN PATENT DOCUMENTS

| | | |
|---|---|---|
| 2523661 | 11/1976 | Fed. Rep. of Germany . |
| 2614392 | 10/1988 | France . |
| 456691 | 10/1988 | Sweden . |
| WO89/09912 | 10/1989 | World Int. Prop. O. . |

*Primary Examiner*—Edward G. Favors

*Attorney, Agent, or Firm*—Shapiro and Shapiro

[57] ABSTRACT

An incinerating furnace, such as a cremation furnace or other batchwise chargeable furnace, is arranged with a main combustion chamber (1), from which the fumes are adapted to be led away through a following chamber arrangement (6–17) connected with a flue. The furnace is characterized in that the chamber arrangement is equipped with at least one additional source of heat (9) adapted to increase the temperature of the fumes, that beyond a passage or gate (7) in a free flow preventing partition wall or the like (8) is arranged a turbulator plate device (10) having means for blowing in air in a direction opposite to the predominant flow direction of the fumes or combustion gases, that the through-flow area of the gate of the partition wall is in a defined relation to the total fumes through-flow area between the turbulator plate device (10) and the adjacent chamber portion walls (and preferably comparable thereto), and that, seen in the flow direction, beyond the turbulator plate device (10) and the through-flow area surrounding same is a further gate or passage (14) having an adjustable cross-section area.

7 Claims, 3 Drawing Sheets

INCINERATING FURNACE

TECHNICAL FIELD OF THE INVENTION

The present invention relates to an arrangement in incinerating furnaces of a specific kind, viz. cremation furnaces and furnaces for similar purposes adapted to be charged in batches.

BACKGROUND OF THE INVENTION

Present furnaces for cremation and like purposes are, with extremely few exceptions, based on old technology, hardly meeting the functional demands of today, especially concerning smoke emission. Apart from older constructions having electrical heating, in some instances supplemented with wood-firing, which are passed over here, cremation furnaces normally have a supporting source of heat in the form of an oil or gas burner which sees to that necessary combustion temperature is reached in the furnace chamber.

On incinerating biological material including cremation, as well as on incinerating other materials temporarily generating large smoke volumes, an efficient final burn-out of the fumes before any flue gas cleaning takes place is necessary. However, such efficient final burn-out is not achievable in existing constructions. On the contrary and as a result of the dimensioning of the combustion chamber and flue chamber for an average combustion value, heavy smoke emission through the funnel may occur on charging the furnace and on the disintegration of the burning material.

The supporting heating mentioned above is necessary as the material to be burned and especially the biological material has a low combustion supporting energy content.

One problem with incineration of the present kind is that the combustion has a very un-even progress with a high load during the initial phase and and a progressively subsiding load towards the end with corresponding gas generation.

The un-even progress of combustion and the associated un-even energy demand/consumption of present constructions result in varying temperatures of the fume or combustion gases, which in turn, have a tendency for forming streaks of streams resulting in un-allowable emissions of non burned out gases and of un-desired materials, e.g. toxic combines, mercury vapours and the like.

The main problem, technically seen, at cremation furnaces resulting in an un-even combustion load, is the batchwise charging of the furnace—cremations are executed one after the other—and this amplies that one can not, as in furnaces for continuous and even charging of material to be burned, keep up a continuous and essentially invariable progress of combustion.

OBJECT OF THE INVENTION

A principal object of this invention is to make it possible to reach an efficient final burnout of the combustion fumes in spite of the fact that they, because of the un-even combustion progress, vary both in volume and contents. An additional object is to secure such a final burning out of the fumes that they cause no environmental disadvantages, as well as no aesthetic disadvantages and above all a final burning out which neutralizes environmentally hazardous hydrocarbons, toxic compounds and the like, which have had to be endured with conventional technology.

SUMMARY OF THE INVENTION

The invention is based on the understanding that in order to reach the desired efficient final burning out it must be arranged for the fumes to be collected in an after-burning chamber where a necessary high and constant temperature level can be secured, and further seen to that secondary and tertiary air necessary for the combustion is added and simultaneously a mixing of the gases in order to eliminate the risk for the forming of streaks of non burned hydrocarbons and the like is achieved. The foregoing is accomplished in accordance with the invention by arranging, after the combustion chamber proper, a first collecting or balancing chamber, which—seen in the direction of the flow—further away is restricted by a passage or gate having an area adapted to a pre-determined volume and velocity of gas, and inside such chamber operates—essentially in the direction of flow of the gases—an oil or gas burner facilitating the final burning out. Inside a further chamber situated on the other or far side of said gate or passage there is a turbulator plate device arranged to cause turbulence and having a number of air nozzles essentially as described in SE 456 691. By the influence of the turbulator plate device, which has substantially the same area as the passage or gate, secondary air is blown against the flow of fumes passing outwardly through said passage or gate, The turbulator plate device causes a vigorous movement of the fumes simultaneously as the secondary air is made to closely mix with the fumes. In addition, there may be secondary air supplied through nozzles arranged adjacent or in the passage or gate. The free area around the turbulator plate between the same and the walls of the chamber is to be essentially as large as the area of the passage or gate opening. At the remote wall of the turbulator plate device housing chamber, there is arranged another gate and such gate, which may have the same area as the earlier mentioned gate, preferably has an adjustable opening area, preferably with displaceably arranged side portions enclosing the gate. The estimated volume of fumes or gases to flow through the opening is determining for the area.

It is an advantage if the adjusting of the gate area is continuously governed relative to the course of incineration or combustion or relative to designed volume of fumes and fume velocity. Beyond this gate, there is arranged an expansion chamber portion communicating with the flue or funnel allowing further burning out. Tertiary air may be supplied adjacent the remote adjustable area gate for enabling and facilitating burning out of any nonburned gas residues and for controlling the fume or gas temperature.

BRIEF DESCRIPTION OF THE DRAWINGS

An embodiment of the incinerating furnace according to the invention will be described below with references to the attached drawings in which.

Figure 1:
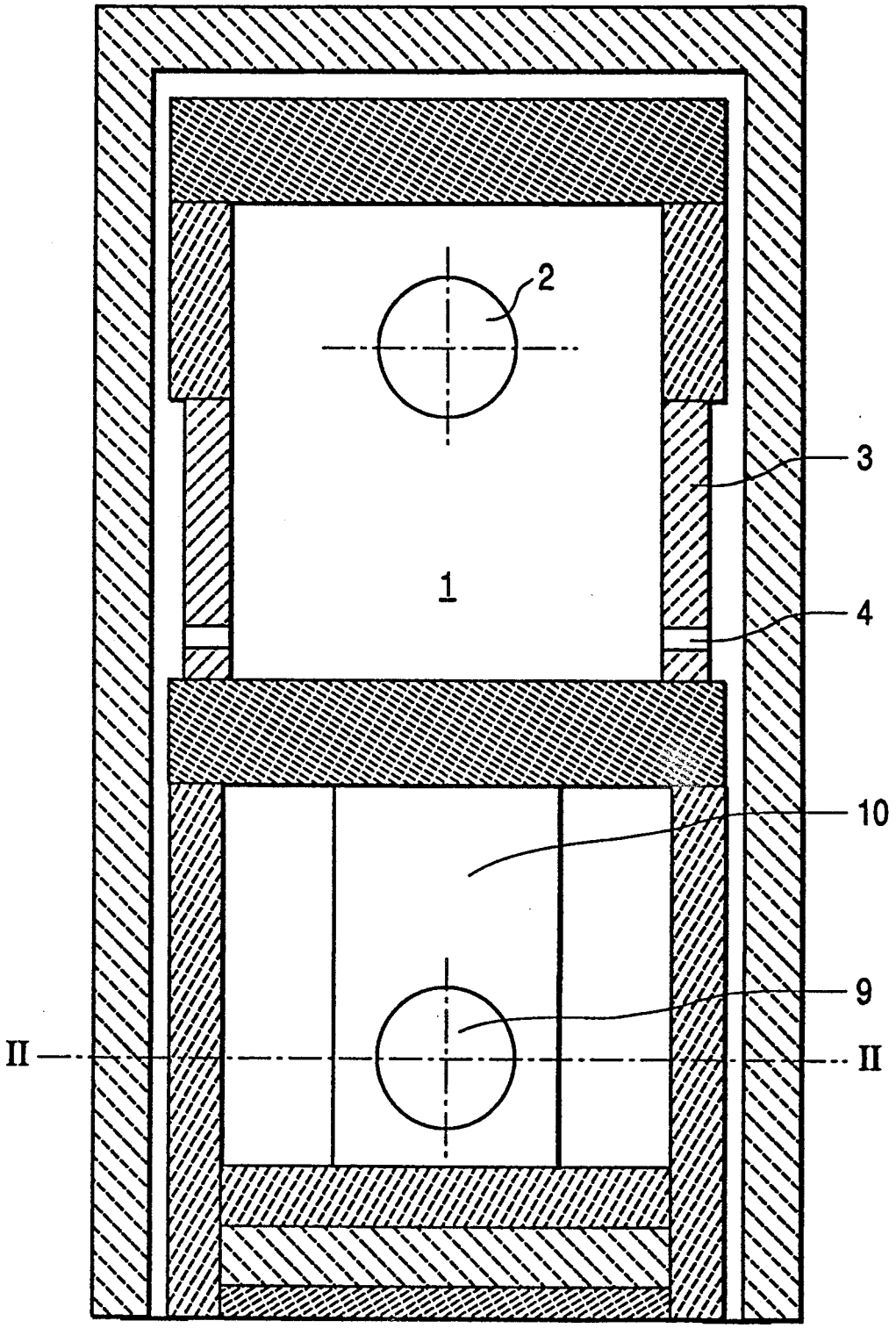
FIG. 1 is a schematical cross sectional view through an incinerating furnace according to the invention, taken along line I—I in FIG. 2.
Figure 2:
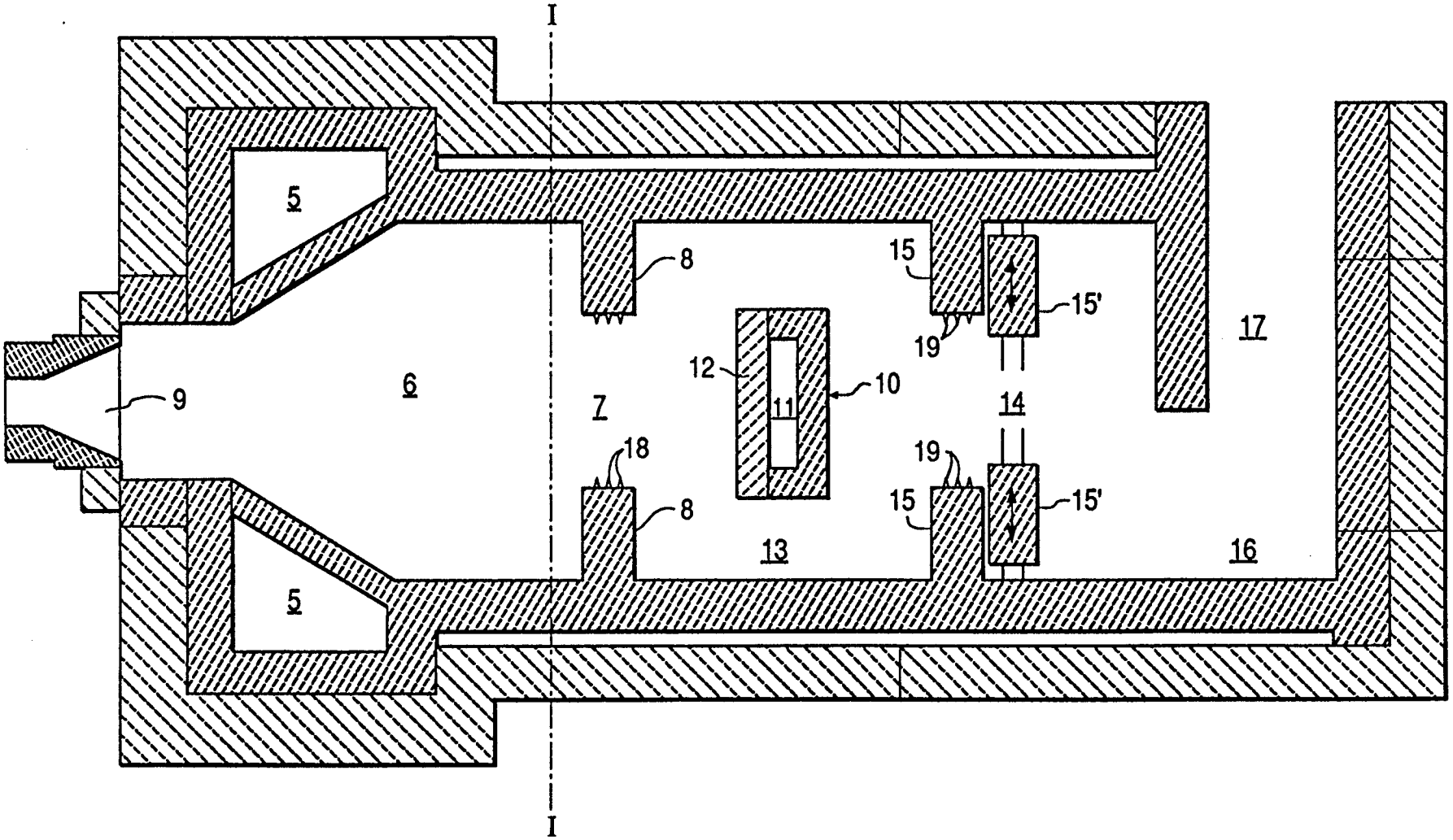
FIG. 2 is a schematical horizontal sectional view through the lower portion of the furnace essentially along line II—II in FIG. 1.
Figure 3:
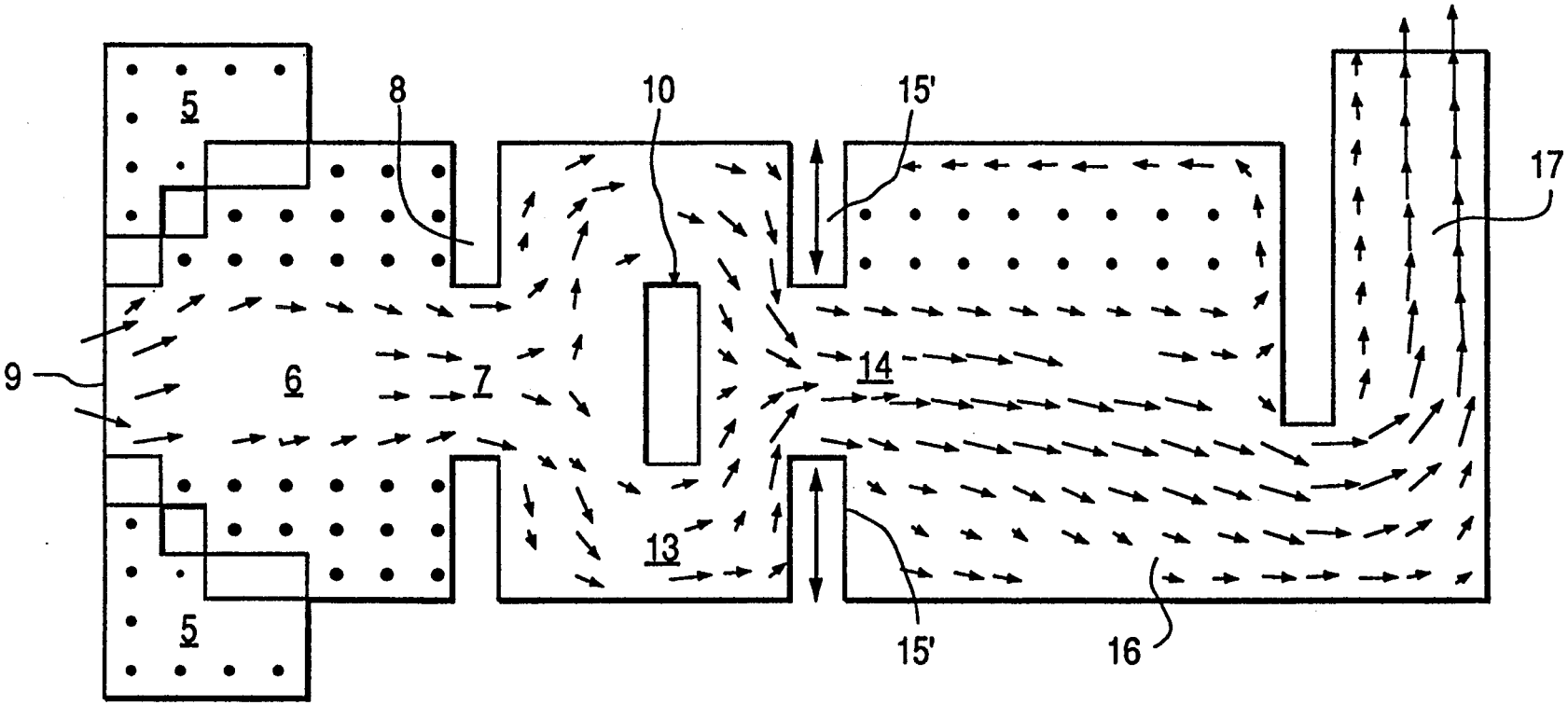
FIG. 3 is a graphical picture illustrating the movements and velocities within the furnace according to the invention.

In the arrangement according to the invention as illustrated in the drawings, the main combustion chamber proper is designated 1. In said arrangement have been included only such details necessary for understanding the invention. The combustion chamber is charged through a door and has at the wall opposite the door an oil or gas burner 2. Along the sides of the combustion chamber there are arranged controllable nozzles and/or perforated ceramic tiles 3, through which controlled pre-heated primary combustion air is supplied. The fumes generated during the combustion leave via the remote portion of the room and flow downwardly through the fume channels designated 5 in FIG. 2 and into the after burner chamber arranged according to this invention. The after burner chamber includes a first chamber portion 6, into and through which the fumes from the combustion chamber flow and pass towards a gate 7 in a first partition wall 8, which may be provided with secondary air blowers 18. At the rear wall of the chamber portion 6 there are oil or gas burners 9 directed co-current with the flow of the gas flowing towards the gate 7.

Seen in the direction of flow there is, beyond the gate 7, a so called turbulator plate device 10 including a body of fire proof material forming a channel 11 and one side of which consists of or at least includes a perforated plate 12 of high-temperature resistant material. Via the channel 11 and through the perforations of the plate 12 air is blown in, which air, accordingly, will work in counterflow against the flow direction of the fumes. The area of the turbulator plate is so adapted in relation to the cross section area of the chamber portion housing the turbulator plate device that the total free area on each side of said device essentially corresponds to the through flow area of the gate 7. The area of the turbulator plate device 10 also preferably has a cross section area of the same size.

The chamber portion 13 housing the turbulator plate device 10 is, downstream in the flow direction defined by a further wall 15 having a gate 14. This wall includes movable portions 15' so that the opening or free area of the gate 14 can be varied in relation to the volume or speed of the fumes. Beyond this gate 14 a reception or collecting chamber portion 16 is arranged, and from this portion a flue channel 17 emerges. The channel 17 is connected to the funnel or to any following cooling surface means and/or flue gas cleaners connected thereto (not shown). Besides the perforations of the turbulator plate 11 for the blowing in of tertiary air, there are air nozzles in the gas channel enhancing the turbulence, and nozzles for supplying secondary air adjacent the forward gate 7. The air supply takes place; a) as primary air through nozzles arranged at the sides of the combustion chamber, b) as secondary air in the channel leading to the after-burner chamber and at the sides of the first gate and c) as tertiary air through the turbulator plate.

An average course of combustion is characterized by one phase of very high effect following the charging during the the oxidizing of the more easily combustible substances, followed by a less intensive phase, and these two initial phases have a duration of about fifteen minutes. After that follows a more quiet combustion phase with a duration of about one hour. If the load relating to the effect is regarded and the first phase is given the value 6 for the first intensive period, it will be reduced during the subsequent period to the value 5 and during the remaining time be at the value 1.

Consequently the volume of the smoke or fumes, which has a given relation to the course of combustion, will be many times larger at the beginning of the combustion cycle than later on and this implies that the after burning chamber must be dimensioned for receiving also the initial large volumes of gas and fumes. By immediate increasing of the temperature of the fumes entering the first chamber by means of the oil or gas burner 9 (said fumes during the initial intensive phases containing large amounts of unburned gas and substances carried by the gas), and furthermore by supplying secondary air through the turbulator plate device 10 against the predominant flow direction of the fumes, the heated gases meeting the secondary air will be brought into a vigorous turbulence. The area relations before and after the turbulator plate device ensure that the velocity is maintained at the intended level. After having passed the chamber portion 13 housing the turbulator plate device 10, the fumes, whilst proceeding to burn out, reach the remote gate 14, the area of which in order to affect the passing through velocity is changeable by moving wall or door portions 15'. The excess air amount in the burned out gases may be increased through tertiary air nozzles 19 arranged at the wall 15 in order to ensure burning out of any residues and in order to reduce the temperature of the gases, especially if they are intended to pass dust separators or similar devices calling for lower temperatures than the one prevailing in the exhaust opening, i.e. 1,000 degrees centrigrade or higher.

The arrangement may be modified in a number of ways without deviating from the basic ideas behind the invention. The first gate e.g. having one opening only may, thus, be replaced by a multitude of smaller openings having a total area which, considering frictional losses and the like, corresponds to the free area around the turbulator plate device. The gate function may even be achieved by block or brick like units built or stacked with intermediary spaces so that a multitude of openings are achieved. The rear gate 14 may also be arranged in alternative ways.

I claim:

1. An incinerating furnace having a main combustion chamber and an after-burner chamber arrangement in communication with said main combustion chamber and to which combustion fumes flow from said main combustion chamber, characterized in that said after-burner chamber arrangement includes supplementary heat source means independent of a heat source of said main combustion chamber for heating said combustion fumes, a free-flow preventing wall having first passage means for passing a flow of the combustion fumes therethrough, turbulator plate means disposed downstream of said first passage means for blowing in air in a direction opposite to a predominant flow direction of the combustion fumes to supply oxygen to the fumes and bring bout a turbulence facilitating combustion of the fumes, the through-flow area of said first passage means having a predetermined relation to a total fume through-flow area between said turbulator plate means and adjacent surrounding chamber walls of said after-burner chamber arrangement, and adjustable-area passage means disposed downstream from said turbulator plate means for adjustably controlling the flow velocity of the fumes.

2. An incinerating furnace according to claim 1, wherein the through-flow area of said first passage means is substantially the same as that between said turbulator plate means and said adjacent surrounding chamber walls.

3. An incinerating furnace according to claim 2, wherein said after-burner chamber arrangement is further provided with means for blowing in secondary air near wall portions defining said first passage means.

4. An incinerating furnace according to claim 1, wherein said after-burner chamber arrangement is further provided with means for blowing in secondary air near wall portions defining said first passage means.

5. An incinerating furnace according to claim 1, wherein said supplemental heat source means includes one of a gas or oil burner acting substantially co-current with the predominant flow direction of the fumes.

6. An incinerating furnace according to claim 1, wherein said adjustable-area passage means includes relatively displaceable wall portions.

7. An incinerating furnace according to claim 6, wherein said after-burner chamber arrangement is further provided with means for blowing in additional air near said adjustable-area passage means.

* * * * *